US005977705A

United States Patent [19]

Sinor et al.

[11] Patent Number: 5,977,705

[45] Date of Patent: Nov. 2, 1999

[54] PHOTOCATHODE AND IMAGE INTENSIFIER TUBE HAVING AN ACTIVE LAYER COMPRISED SUBSTANTIALLY OF AMORPHIC DIAMOND-LIKE CARBON, DIAMOND, OR A COMBINATION OF BOTH

[75] Inventors: Timothy W. Sinor, Plano; Joseph P. Estrera, Dallas; Keith T. Passmore, Rowlett, all of Tex.

[73] Assignee: Litton Systems, Inc., Beverly Hills, Calif.

[21] Appl. No.: 08/639,561

[22] Filed: Apr. 29, 1996

[51] Int. Cl.[6] ..... H01J 40/06

[52] U.S. Cl. ..... 313/542; 313/543; 313/544; 313/524; 313/523; 313/309

[58] Field of Search ..... 313/542, 543, 313/544, 524, 523, 309

[56] References Cited

U.S. PATENT DOCUMENTS

| | | | |
|---|---|---|---|
| 3,894,258 | 7/1975 | Buttrewick | 313/102 |
| 3,906,277 | 9/1975 | Schade | 313/365 |
| 3,914,136 | 10/1975 | Kressel | 148/171 |
| 3,951,698 | 4/1976 | Wilson et al. | 148/33.4 |
| 3,960,620 | 6/1976 | Ettenberg | 148/175 |
| 4,096,511 | 6/1978 | Gurnell et al. | 357/30 |
| 4,115,223 | 9/1978 | Thrush | 204/129.9 |
| 4,563,614 | 1/1986 | Howorth | 313/524 |
| 4,644,221 | 2/1987 | Gutierrez et al. | 313/373 |
| 4,980,312 | 12/1990 | Harris et al. | 437/90 |
| 5,268,570 | 12/1993 | Kim | 250/214 |
| 5,506,402 | 4/1996 | Estrera et al. | 250/214 |
| 5,578,901 | 11/1996 | Blanchet-Fincher et al. | 313/309 |
| 5,619,091 | 4/1997 | Anderson et al. | 313/104 |
| 5,684,360 | 11/1997 | Baum et al. | 313/542 |
| 5,703,435 | 12/1997 | Kumar et al. | 313/309 |

OTHER PUBLICATIONS

D.G. Fisher, R.E. Enstrom, J.S. Escher, H.F. Gossenberger, and J.R. Appert, Photoemission Characteristics of Transmission–Mode Negative Electron Affinity GaAs and (In,Ga)As Vapor–Grown Structures, IEEE Transactions on Electron Devices, vol. ED–21, No. 10 pp. 641–649 (1974).

R.E. Nahory, M.A. Pollack, and J.C. DeWinter, Growth and characterization of liquid–phase epitaxial $In_xGa_{1-x}As$, Journal of Applied Physics, vol. 46, No. 2 pp. 775–782 (1975).

A.H. Sommer, The element of luck in research–photocathodes 1930 to 1980, J. Vac. Sci. Technol. A 1(2), pp. 119–124, Apr.–Jun. 1983.

G. Vergara, L.J. Gomez, J. Capmany and M.T. Montojo, *Adsorption kinetics of cesium and oxygen on GaAs(100)*, Surface Science 278 pp. 131–145 (192).

D.G. Fisher, R.E. Enstrom, J.S. Escher, and B.F. Williams, *Photoelectron surface escape probability of (Ga,In)As: Cs–O In the 0.9 to ≈ 1.6 μ range**, J. Appl. Phys. vol. 43, No. 9, pp. 3815–3823 (1972).

R.L. Bell, L.W. James, and R.L. Moon, *Transferred electron photoemission from InP†*, Appl. Phys. Letters, vol. 25, No. 11, pp. 645–646 (1974).

J.S. Escher and R. Sankaran, *Transferred Electron Photoemission to 1.4 μ*, Appl. Phys. Lett. 29, 87 (1976).

J.S. Escher, P.E. Gregory, S.B. Hyder, and R. Sankaran, *Transferred–electron photoemission to 1.65μ*from InGaAs[a], J. Appl. Phys. 49(4), pp. 2591–2592 (1978).

P.E. Gregory, J.S. Escher, S.B. Hyder, Y.M. Houng, and G.A. Antypas, *Field–assisted minority carrier electron transport across a p–InGaAs/p–InP heterojunction*[a], J. Vac. Sci. Technol. 15(4), pp. 1483–1487 (1978).

(List continued on next page.)

*Primary Examiner*—Sandra O'Shea
*Assistant Examiner*—Ronald E. DelGizzi
*Attorney, Agent, or Firm*—Baker & Botts, L.L.P.

[57] ABSTRACT

A novel photocathode and image intensifier tube include an active layer comprised substantially of amorphic diamond-like carbon, diamond, or a combination of both. The photocathode has a face plate coupled to an active layer. The active layer is operable to emit electrons in response to photons striking the face plate.

18 Claims, 1 Drawing Sheet

OTHER PUBLICATIONS

J.S. Escher, R.L. Bell, P.E. Gregory, S.Y. Hyder, T.J. Maloney, and G.A. Antypas, *Field–Assisted Semiconductor Photoemitters for the 1–2 μ Range*, IEEE Transactions on Electron Devices ED–27, No. 7, pp. 1244–1250 (1980).

J.S. Escher, P.E. Gregory, S.B. Hyder, R.R. Saxena, and R.L. Bell, *Photoelectric Imaging in the 0.9–1.6 Micron Range**, IEEE Electron Device Letters, vol. EDL–2, No. 5, pp. 123–125 (1981).

K. Costello, G. Davis, R. Weiss, and V. Aebi, SPIE Proceedings,: *Electron Image Tubes and Image Intensifiers II*, vol. 1449 (1991).

I.P. Csorba, *Recent advancements in the field of image intensification: the generation 3 wafer tube*, Applied Optics, vol. 18(14), pp. 2440–2444 (Jul. 1979).

I.P. Csorba, *Current Status of Image Intensification*, Miltronics, pp. 2–11 (Mar./May 1981).

I.P. Csorba, *Current Status and Performance Characteristics of Night Vision Aids*, Opto–Electronic Imaging, Chapter 3, pp. 34–63 (1985).

K.A. Costello, V.W. Aebi and H.F. MacMillan, *Imaging GaAs Vacuum Photodiode with 40*

Quantum Efficiency at 530 nm, SPIE vol. 1243 Electron Image Tubes and Image Intensifiers pp. 99–104(1990).

A.A. Narayanan, D.G. Fisher, L.P. Erickson and G.D. O'Clock, *Negative electoron affinity gallium arsenide photocathode grown by molecular beam epitaxy*, J. Appl. Phys. vol. 56(6) pp. 1886–1887 Sep. 15, 1984.

Stringfellow, G.B., "Lattice Parameters and Crystal Structure of Indium–Gallium–Arsenide," *Properties of Lattice–Matched and Strained Indium–Gallium–Arsenidei*, P. Bhattacharya, Edit, Institution of Electrical Engineers, London, United Kingdom, 1993.

Takahashi, N.S., "Lattice Parameters, Molecular and Crystal Densitites of Aluminun–Gallium–Arsenide," Properties of Aluminum–Gallium–Arsenide, S. Adachi, Editor, Institution of Electrical Engineers, London, United Kingdom, 1993.

PHOTOCATHODE AND IMAGE INTENSIFIER TUBE HAVING AN ACTIVE LAYER COMPRISED SUBSTANTIALLY OF AMORPHIC DIAMOND-LIKE CARBON, DIAMOND, OR A COMBINATION OF BOTH

TECHNICAL FIELD OF THE INVENTION

This invention relates generally to photocathodes, and more particularly, to an improved photocathode and image intensifier tube having an active layer comprised substantially of amorphic diamond-like carbon, diamond, or a combination of both and a method for making the same.

BACKGROUND OF THE INVENTION

Image intensifier devices employ a photocathode for conversion of photons to electrons, a microchannel plate for electron multiplication, and a phosphor-coated anode to convert electrons back to photons. The microchannel plate image intensifier is currently manufactured in two types that are commonly referred to as generation II and generation III type image tubes. The primary difference between these two types of image intensifiers lies in the type of photocathode employed. Generation II image intensifier tubes have a multi-alkali photocathode with a spectral sensitivity in the range of 400–900 nannometers. This spectral range can be extended to the blue or red by modification of the multi-alkali composition and/or thickness. Generation III image intensifier tubes have a p-doped gallium arsenide (GaAs) photocathode that has been activated to negative electron affinity (NEA) by the adsorption of cesium and oxygen on the surface. This material has approximately twice the quantum efficiency of the generation II photocathode. An extension of the spectral response to the near infrared can be accomplished by alloying indium with gallium arsenide.

Existing photocathodes have several disadvantages. Generation III photocathodes are generally made using expensive processes such as metal/organic/chemical/vapor deposition (MOCVD) or molecular beam epitaxy (MBE). Besides being expensive, processes such as the MOCVD process use toxic chemicals which must be carefully controlled to avoid harming the people manufacturing the photocathodes.

Generation III photocathodes are normally heat cleaned to remove surface oxides and contaminants just prior to activation and seal in an evacuated image-intensifier tube. Small leaks in such tubes will sometimes prevent a vacuum from forming and the tube will be unusable. If a proper vacuum seal is not formed or if a leak develops, one can normally not attempt to seal a generation III photocathode in a different image intensifier tube. Gallium arsenide photocathodes often suffer lattice damage when heated a second time to remove surface contaminants rendering the cathode unusable.

Existing generation III photocathodes are also sensitive to lasers. Direct contact of a laser beam on a generation III photocathode ordinarily destroys the photocathode. Sensitivity to laser energy is a drawback when night vision equipment is being used for military operations as many modern weapon systems use lasers.

SUMMARY OF THE INVENTION

The invention avoids many of the disadvantages of existing photocathodes by using an active layer comprised substantially of amorphic diamond-like carbon, diamond, or a combination of both. One aspect of the invention is a photocathode comprising a face plate coupled to an amorphic diamond-like carbon active layer. The amorphic diamond-like carbon active layer is operable to emit electrons in response to photons striking the face plate. A method for making the photocathode is also disclosed. Another aspect of the invention is an image intensifier tube using the previously described photocathode. Yet another aspect of the invention is a photocathode similar to that described above except that it employs a diamond active layer. A combination of amorphic diamond-like carbon and diamond can also be used for the active layer.

The invention has many important technical advantages. The disclosed photocathodes can be made using an ordinary deposition system. The amorphic diamond-like carbon active layer can be created using laser ablation of graphite. In the case of a diamond active layer, the deposition process is performed by high temperature chemical vapor phase deposition (CVD). These processes are less expensive than the processes used to make existing generation III photocathodes. The disclosed photocathode can also be made inexpensively because the amorphic diamond-like carbon or diamond active layer can be formed directly on the face plate or on top of other layers formed on the face plate. No bonding is required. The relatively simple process used to make the disclosed photocathode avoids many of the process steps needed to manufacture existing gallium arsenide photocathodes. The invention also avoids the use of the toxic chemicals that are used to form gallium arsenide photocathodes.

The disclosed photocathodes can be more easily mass produced than existing photocathodes. A large number of the disclosed photocathodes can be simultaneously manufactured using a large deposition chamber.

Higher manufacturing yields can be achieved using the disclosed photocathode for image intensifier tubes. If a proper vacuum does not form when making an image intensifier tube, the disclosed photocathode can normally be reprocessed without damaging the active layer. The photocathode can be resealed to a different image intensifier tube. Unlike most existing systems, the disclosed photocathode does not have to be thrown away if a proper vacuum does not form when making an image intensifier tube.

The disclosed photocathode has good photoemissive properties. Experimental results have demonstrated the disclosed photoelectrode has a negative electron affinity even without activating the surface of the photocathode. Because both amorphic diamond-like carbon and diamond are variable bandgap materials, the range of wavelengths to which the disclosed photocathodes are sensitive can be easily tuned. It is also believed that the disclosed photocathodes are more laser resistant than existing photocathodes.

Applications of the invention include military applications, gated imaging technology, CCD camera technology, and scientific applications.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
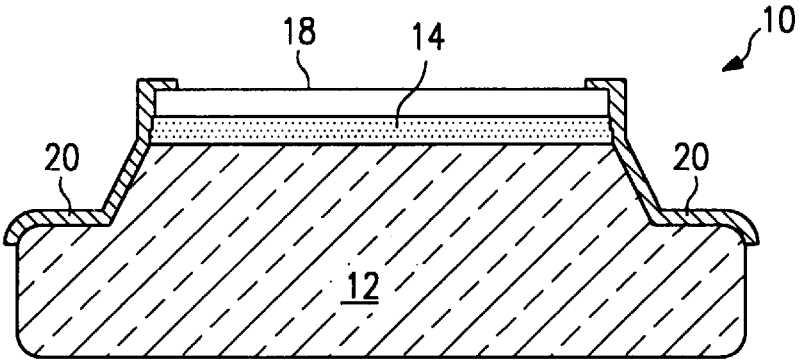
FIG. 1 illustrates a photocathode made in accordance with the invention.
Figure 2:
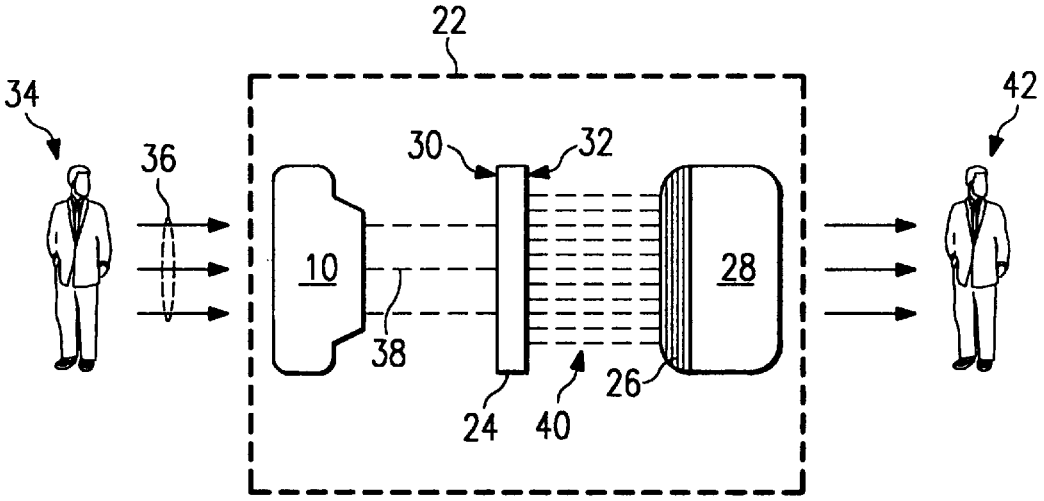
FIG. 2 illustrates an image intensifier tube made in accordance with the invention.

The preferred embodiment of the present invention and its advantages are best understood by referring to FIGS. 1 and 2 of the drawings, like numerals being used for like and corresponding parts of the various drawings.

FIG. 1 illustrates a photocathode 10 made in accordance with the teachings of the present invention. Photocathode 10 comprises face plate 12, reflective layer 14, active layer 18, and electrode 20. Reflective layer 14 comprises a thin layer of silicon nitride, approximately 900–1,000 angstroms thick, deposited on a surface of face plate 12 to serve as an antireflection coating. Active layer 18 is formed on top of reflective layer 14 and comprises a thin film of amorphic diamond-like carbon or diamond or a combination of both, with a thickness of between approximately 0.5 and 1.35 microns. Electrode 20 is coupled to face plate 12, reflective layer 14, and active layer 18. Electrode 20 is a chrome/gold electrode.

In operation, photons strike the surface of face plate 12. In response, photocathode 10 emits electrons from active layer 18.

The method of making photocathode 10 in the case of amorphic diamond-like carbon active layer can also be understood by referring to FIG. 1. First, a thin layer of silicon nitride is deposited on face plate 12 to serve as reflective layer 14. Then, a thin film of amorphic diamond-like carbon is deposited using pulsed laser ablation of graphite to form active layer 18. Electrode 20 is applied to the circumference of face plate 12, reflective layer 14, and active layer 18, using standard thin film techniques. Electrode 20 provides an electrical contact between photocathode 10 and other components that may be connected to it. Chrome-gold was chosen for this embodiment because it aids in vacuum sealing an image intensifier tube.

In the case of a diamond active layer, the method of making photocathode 10 can also be understood by referring to FIG. 1. First, a thin layer of silicon nitride is deposited on face plate 12 to serve as reflective layer 14. Then, a thin film of diamond is deposited using chemical vapor deposition techniques to form active layer 18. Electrode 20 is applied to the circumference of face plate 12, reflective layer 14, and active layer 18 using standard thin film techniques. Electrode 20 provides an electrical contact between photocathode 10 and other components that may be connected to it. Chrome/gold was chosen for this embodiment because it aids in vacuum sealing an image intensifier tube.

In the case of an active layer having a combination of amorphic diamond-like carbon and diamond, the active layer may be formed using either laser ablation or chemical vapor deposition.

The embodiment in FIG. 1 is only one example of the invention. Various substitutions, omissions, and additions may be made without departing from the scope of the invention. In some photocathodes 10, reflective layer 14 could be omitted. Reflective layer 14 can also be a different thickness and/or made of a material other than silicon nitride.

The resistivity of active layer 18 could be reduced through doping. Active layer 18 will normally be doped so that it becomes a p-type material. The thickness of active layer 18 could also vary from that of active layer 18 in the preferred embodiment.

In the embodiment illustrated in FIG. 1, face plate 12 is a 7056 glass input optic. Face plates 12 made of other materials such as quartz or fiberoptic could also be used. Electrode 20 could be made of a material other than chrome-gold.

FIG. 2 illustrates an image intensifier tube 22 made in accordance with the teachings of the present invention. Image intensifier tube 22 uses a photocathode 10 operable to emit electrons in response to photons emitted or scattered from an image. A display apparatus adjacent to photocathode 10 is operable to transform the emitted electrons into a visible light image. In the embodiment illustrated in FIG. 2, the display apparatus comprises a multi-channel plate 24 adjacent to photocathode 10, a phosphor screen 26 adjacent to multi-channel plate 24 and a fiberoptic anode 28 adjacent to phosphor screen 26. Other types of display apparatus could also be used.

Multi-channel plate 24 comprises a thin wafer having several parallel hollow glass fibers, each oriented slightly off axis with respect to incoming electrons. Multi-channel plate 24 multiplies incoming electrons with a cascade of secondary electrons through the channels by applying a voltage across the two faces 30, 32 of multi-channel plate 24. The surface of phosphor screen 26 receives electrons from multi-channel plate 24 and phosphor screen 26 generates a visible light image. Fiberoptic anode 28 translates the image produced by phosphor screen 26 using, for example, fiberoptic bundles to form a translated image that is visible to an observer.

FIG. 2 further illustrates the operation of image intensifier tube 22. An image 34 emits or scatters photons 36 which are directed onto a surface of photocathode 10. Photocathode 10 transforms photons 36 into electrons 38 which gain energy from an electric field between photocathode 10 and multi-channel plate 24. Multi-channel plate 24 multiplies the incoming electrons 38 with a cascade of secondary electrons to generate multiplied electrons 40 which are then directed by a high electric field between multi-channel plate 24 and the surface of phosphor screen 26. As electrons 40 strike phosphor screen 26, they generate a visible light image which is then translated by fiberoptic anode 28 into an output image 42 visible to an observer.

The method of making image intensifier tube can also be understood by referring to FIG. 2. First, photocathode 10 is formed as described above in connection with FIG. 1. Photocathode 10 is then etched to remove moisture, oxides, and surface contaminants, which have attached to the surface of active layer 18 during previous processing. Photocathode 10 is then placed into a vacuum system and heated to clean the surface of active layer 18. To surface activate active layer 18, cesium and oxygen vapor is evaporated onto the surface of active layer 18. Another surface activation alternative is to heat active layer 18 to an elevated temperature and expose it to a trace amount of hydrogen. These steps may be omitted depending upon the application for which image intensifier tube 22 is being used and upon the construction of the remainder of image intensifier tube 22. During evaporation, an input light enters the surface of active layer 18, producing an output current measured from electrode 20. Cesium and oxygen vapors are further applied until achieving a maximum electrode current. At this point, the evaporation process stops and photocathode 10 is sealed into an image intensifier tube such as image intensifier tube 22.

Photocathode 10 can be produced less expensively than existing gallium arsenide photocathodes because photocathode 10 can be made using ordinary deposition systems for laser ablation of graphite or for chemical vapor deposition of diamond. Photocathode 10 can be manufactured with many less process steps than are required to make gallium arsenide photocathodes. The invention avoids the need to use toxic chemicals during fabrication. Photocathode 10 can be mass produced in a large deposition chamber which may also reduce the costs of manufacturing.

When making a image intensifier tube 22, if a proper vacuum is not formed inside image intensifier tube 22, photocathode 10 will normally be able to be reused to form a different image intensifier tube 22. Photocathode 10 can be reused in this way because photocathode 10 may be chemically etched and heat cleaned in a vacuum to remove residual surface contamination multiple times without damaging active layer 18.

Photocathode 10 has good photoemissive properties such as a negative electron affinity even before the surface of active layer 18 is activated by exposing the surface to controlled amounts of chemicals such as cesium and oxygen or hydrogen. Because amorphic diamond-like carbon and diamond are variable bandgap materials, the range of wavelengths to which photocathode 10 is sensitive can be easily tuned. Photocathode 10 is also believed to be more laser resistant than existing gallium arsenide photocathodes.

Although the present invention and its advantages have been described in detail, it should be understood that various changes, substitutions and alterations can be made therein without departing from the spirit and scope of the invention as defined by the appended claims.

What is claimed is:

1. A photocathode comprising:

a face plate; and an active layer comprised substantially of amorphic diamond-like carbon, the active layer coupled to the face plate and operable to emit electrons in response to photons striking the face plate.

2. The photocathode of claim 1, further comprising:

an anti-reflection coating deposited on the face plate between the face plate and the active layer.

3. The photocathode of claim 2 wherein the anti-reflection coating is silicon nitride.

4. The photocathode of claim 1, further comprising:

an electrode coupled to the face plate and the active layer.

5. The photocathode of claim 1, wherein the active layer is doped to form a p-type material.

6. An image intensifier tube for creating a visible light image from an image that is emitting photons, comprising:

a photocathode having an active layer comprised substantially of amorphic diamond-like carbon, the photocathode operable to emit electrons in response to the photons; and a display apparatus adjacent to the photocathode and operable to transform the emitted electrons into a visible light image.

7. The image intensifier tube of claim 6 wherein the display apparatus comprises:

a multichannel plate adjacent to the photocathode and operable to multiply the emitted electrons to form multiplied electrons;

a phosphor screen operable to receive the multiplied electrons and generate a visible light image therefrom; and a fiber optic anode to translate the visible light image.

8. The image intensifier tube of claim 6, wherein the active layer is doped to form a p-type material.

9. The image intensifier tube of claim 6, wherein the photocathode further comprises:

a face plate;

an anti-reflection coating deposited on the face plate between the face plate and the active layer.

10. A photocathode comprising:

a face plate; and an active layer comprised substantially of amorphic diamond-like carbon and diamond, the active layer coupled to the face plate and operable to emit electrons in response to photons striking the face plate.

11. The photocathode of claim 10, further comprising:

an anti-reflection coating deposited on the face plate between the face plate and the active layer.

12. The photocathode of claim 11 wherein the anti-reflection coating is silicon nitride.

13. The photocathode of claim 10, further comprising:

an electrode coupled to the face plate and the active layer.

14. The photocathode of claim 10, wherein the active layer is doped to form a p-type material.

15. An image intensifier tube for creating a visible light image from an image that is emitting photons, comprising:

a photocathode having an active layer comprised substantially of amorphic diamond-like carbon and diamond, the photocathode operable to emit electrons in response to the photons; and a display apparatus adjacent to the photocathode and operable to transform the emitted electrons into a visible light image.

16. The image intensifier tube of claim 15 wherein the display apparatus comprises:

a multichannel plate adjacent to the photocathode and operable to multiply the emitted electrons to form multiplied electrons;

a phosphor screen operable to receive the multiplied electrons and generate a visible light image therefrom; and a fiber optic anode to translate the visible light image.

17. The image intensifier tube of claim 15, wherein the active layer is doped to form a p-type material.

18. The image intensifier tube of claim 15, wherein the photocathode further comprises:

a face plate;

an anti-reflection coating deposited on the face plate between the face plate and the active layer.

* * * * *